US006311570B1

(12) United States Patent
Niedermühlbichler

(10) Patent No.: US 6,311,570 B1
(45) Date of Patent: Nov. 6, 2001

(54) METHOD OF ADJUSTING A LYING OR SITTING ELEMENT

(76) Inventor: Bartholomäus Niedermühlbichler, Sonnseite 121, A-6353 Going (AT)

( * ) Notice: Subject to any disclaimer, the term of this patent is extended or adjusted under 35 U.S.C. 154(b) by 0 days.

(21) Appl. No.: 09/573,935

(22) Filed: May 18, 2000

(51) Int. Cl.[7] ..... G01L 1/26

(52) U.S. Cl. ..... 73/862.392; 297/284.2

(58) Field of Search ..... 73/862.381, 862.391, 73/862.42, 862.451, 862.392, 862.621; 297/284.2, 284.3

(56) References Cited

U.S. PATENT DOCUMENTS

| | | | | |
|---|---|---|---|---|
| 2,788,531 | | 4/1957 | Dye et al. . | |
| 4,057,291 | * | 11/1977 | Dubinsky | 297/440.11 |
| 4,585,272 | * | 4/1986 | Ballarini | 297/284.3 |
| 4,837,878 | | 6/1989 | Huemer . | |
| 4,999,948 | * | 3/1991 | Hodgens | 49/74.1 |
| 5,148,706 | | 9/1992 | Masuda et al. . | |
| 5,446,933 | | 9/1995 | Gabelhouse . | |
| 5,523,040 | | 6/1996 | Krouskop . | |

FOREIGN PATENT DOCUMENTS

| | | |
|---|---|---|
| 19504527A1 | 8/1995 | (DE) . |
| 0111898A | 6/1984 | (EP) . |
| 270582A | 6/1988 | (EP) . |
| 0489310A1 | 6/1992 | (EP) . |
| WO 87/07125A | 12/1987 | (WO) . |

* cited by examiner

*Primary Examiner*—Max Noori
(74) *Attorney, Agent, or Firm*—Hoffmann & Baron, LLP

(57) ABSTRACT

Method of adjusting a lying or sitting element with a supporting frame and elastic strips running transversely to this with adjustable initial tension which are downwardly deformed to varying extents when a person is placed on them, an ideal contour of the deformed lying or sitting surface and an ideal pressure distribution being individually determined for the user and, while the user is resting on the element, both the deformation of the strips and the bearing pressure being measured and being approximated to the desired value by changing the tension.

4 Claims, 1 Drawing Sheet

METHOD OF ADJUSTING A LYING OR SITTING ELEMENT

FIELD OF INVENTION

The invention relates to a method of adjusting a lying or sitting element with a supporting frame and elastic strips running transversely to this with adjustable initial tension which are downwardly deformed to varying extents when a person is placed on them.

DESCRIPTION OF THE RELATED ART

A lying element is known from EP 0 270 582, in which several non-extensible strips running transversely to the carrier frame are provided on a supporting frame. The length of the strips is adjustable. The contour of the loaded element is determined, independently of the weight of the person lying on it, by the length of the non-extensible strips. The pressure between the strips and the parts of the body resting on them inevitably results from the anatomical conditions.

On the other hand a lying element with elastic strips running transversely to the supporting frame is known from U.S. Pat. No. 2,788,531. The individual strips are not adjustable, but have differing spring characteristics chosen according to statistical considerations. The elasticity of the strips, which is determined by laterally arranged springs, is so great that it is supposedly immaterial whether the user uses the apparatus in a side position or a back position. With the apparatus according to U.S. Pat. No. 2,788, 531, both the contour of the loaded bed and the bearing pressure are established according to the individual conditions. Bearing in mind that, to calculate the statistically determined ideal contour, the human body is assumed to be rotationally symmetrical and that users may display substantial differences from the statistical average, true lying comfort is at best achieved by chance here.

SUMMARY OF THE INVENTION

With the apparatus developed by the applicant which is outlined at the beginning, the contour of the loaded element is determined by elastic strips, the tension of which is adjustable. This means that it is possible to optimally adjust the lying element for the individual user.

To this end, it is provided according to the invention, that an ideal contour of the deformed lying surface and an ideal pressure distribution are individually determined for the user and that, while the user is resting on the lying element, both the deformation of the strips and the bearing pressure are measured and approximated to the desired value by changing the tension.

The ideal contour of the deformed lying surface is sensibly defined not only by theoretical considerations but also by measuring the figure and in particular the shape of the back of the user. Ultrasound measuring apparatuses are suitable aids for this.

With regard to the pressure distribution, it can be considered ideal if each supported part of the skin is equally loaded. The invention firstly allows rough deviations from this ideal in the form of loading peaks to be avoided. In addition, the pressure acting on individual body parts can deliberately be kept relatively high in order to effect a gradual alteration of the predetermined original contour of the user.

BRIEF DESCRIPTION OF THE DRAWING

Details of the invention are explained subsequently with reference to the drawings.

DESCRIPTION OF THE PREFERRED EMBODIMENT

Figure 1:
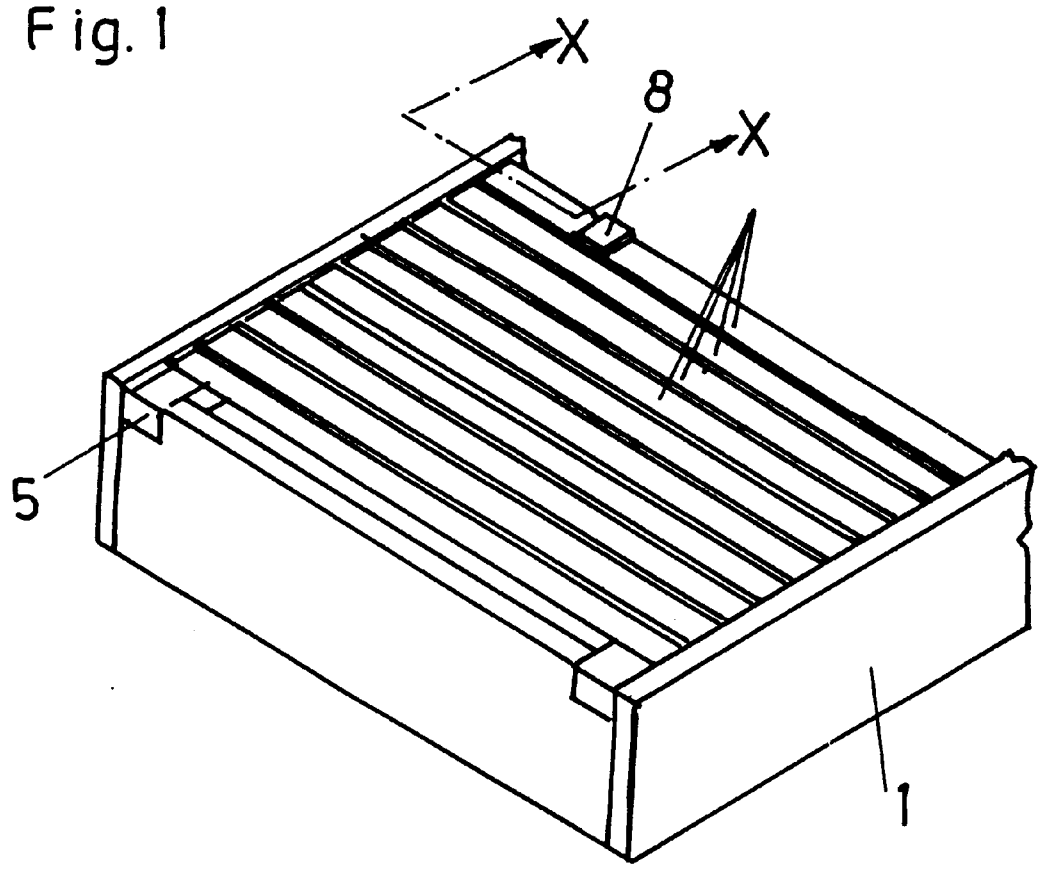
FIG. 1 shows a perspective representation of a part of the lying element and FIG. 2 shows a section along the line X—X in FIG. 1.
Figure 2:
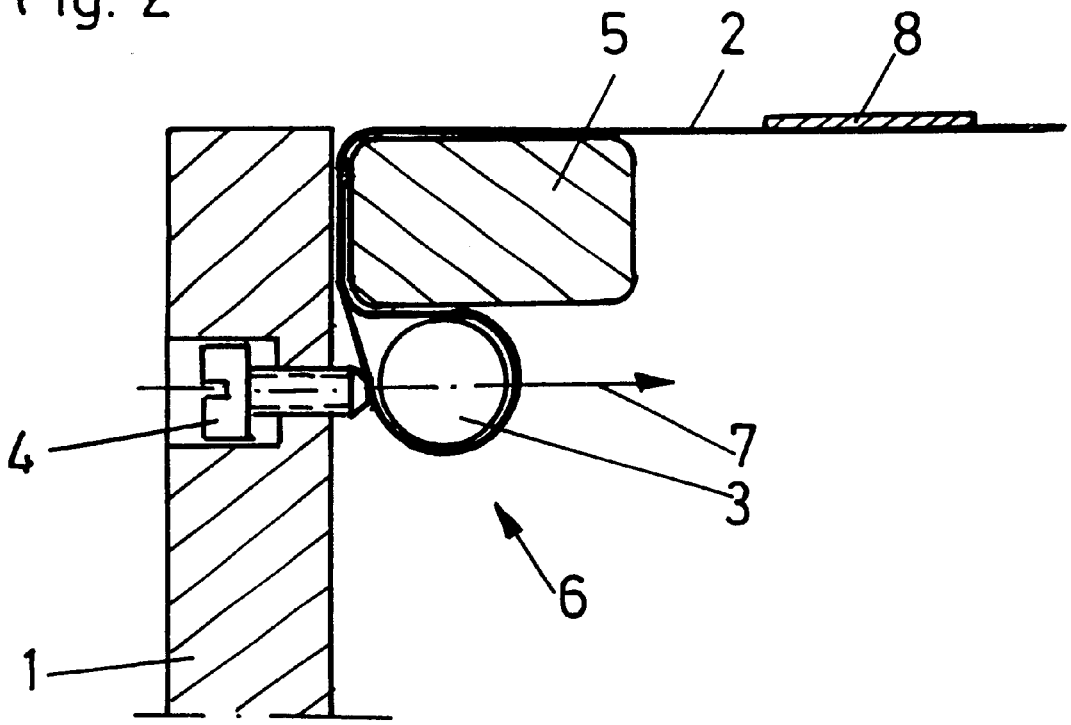

The lying element has a supporting frame 1 with longitudinal supports 5 to which transversely running elastically extensible strips 2 are attached. The strips 2 are in each case attached to the supporting frame 1 on at least one side of the strip 2 via a tensioning apparatus 6 arranged on the supporting frame. A profiled piece 3, to which the strip is attached, is displaced in the direction of the arrow 7 by adjusting the tensioning screw 4 of the tensioning apparatus so that a tensile force is exerted on the corresponding strip 2, by means of which force the strip is initially tensioned.

The set tensions of the individual strips vary. The procedure according to the invention is that the user is laid onto the support and the deflection of the individual strips is measured by an observer positioned underneath the lying element. Simultaneously, using pressure sensors 8, of which only one is shown by way of example, signals corresponding to the bearing pressure are transmitted to an evaluation apparatus. The apparatus is then adjusted, firstly by turning the tensioning screws 4 until the desired contour is achieved. All those tensioning screws 4 at which a pressure deviating excessively from the ideal has been ascertained are then adjusted. The procedure can be repeated until the best possible approximation to the desired pressure and form distribution and thus an optimal compromise is reached.

For the desired pressure measurement, known mats can be used which contain a grid of sensors and reproduce the pressure distribution in different colours on a screen. Such mats are marketed by Novel GmbH in Munich. A simple association of any pressures peaks with the excessively initially tensioned strips 2 responsible for the same, and rapid correction, are thus possible.

What is claimed is:

1. A method of adjusting a lying or sitting element, having a supporting frame and a plurality of elastic strips running transversely to said frame with adjustable initial tension, said strips are downwardly deformed to varying extents when a person is placed on said strips, said method comprises;

determining an ideal contour of the lying or sitting element, determining an ideal pressure distribution of the lying or sitting element, placing a person on said elastic strips, thereby causing said elastic strips to deform and create a bearing pressure, measuring the deformation of said strips and the bearing pressure so that a contour value and a pressure distribution value are obtained, adjusting the tension on the elastic strips so that the contour value and the pressure distribution value closely approximates the ideal contour and the ideal pressure distribution.

2. A method according to claim 1, wherein the ideal contour of the deformed lying or sitting element is determined on the basis of measurement of the person.

3. A method according to claim 1, wherein the ideal pressure distribution is determined on the basis of a uniformly equal pressure.

4. A method according to claim 1, wherein the bearing pressure is measured by means of a pressure-measuring mat which reproduces the pressure distribution in different colours on a screen.

* * * * *